US006644216B1

(12) United States Patent
Cole

(10) Patent No.: US 6,644,216 B1
(45) Date of Patent: Nov. 11, 2003

(54) ADJUSTABLE TABLE LEG

(76) Inventor: Malcolm Frank Cole, Flat 8, 11 Windsor Road, Lower Parkstone, Poole, Dorset, BH14 8SF (GB)

( * ) Notice: Subject to any disclaimer, the term of this patent is extended or adjusted under 35 U.S.C. 154(b) by 241 days.

(21) Appl. No.: 09/315,101

(22) Filed: May 20, 1999

(30) Foreign Application Priority Data

May 20, 1998 (GB) ..... 9810863

(51) Int. Cl.[7] ..... A47F 5/12
(52) U.S. Cl. ..... 108/1; 108/7
(58) Field of Search ..... 108/1, 9, 147.22, 108/147.2, 7, 147; 248/188.2, 371, 398

(56) References Cited

U.S. PATENT DOCUMENTS

| | | | | | |
|---|---|---|---|---|---|
| 1,951,237 | A | * | 3/1934 | Fiene | 108/1 X |
| 3,246,611 | A | * | 4/1966 | Benlian | 108/1 |
| 3,988,021 | A | * | 10/1976 | Grover | 108/1 X |
| 4,237,795 | A | | 12/1980 | Parker | |
| 4,259,909 | A | | 4/1981 | Belina | |
| 4,273,306 | A | | 6/1981 | Change | |
| 4,502,393 | A | * | 3/1985 | Kaiser | 108/1 |
| 4,718,630 | A | * | 1/1988 | Richard | 108/1 X |
| 4,762,321 | A | * | 8/1988 | Chang | 108/147.22 X |
| 5,107,775 | A | | 4/1992 | Langlais et al. | |
| 5,398,620 | A | * | 3/1995 | Rouch | 108/1 |
| 5,649,493 | A | | 7/1997 | Blume | |

FOREIGN PATENT DOCUMENTS

| | | |
|---|---|---|
| GB | 1 497 952 | 1/1978 |
| WO | WO 91/17906 | 11/1991 |

* cited by examiner

*Primary Examiner*—Jose V. Chen
(74) *Attorney, Agent, or Firm*—Nixon & Vanderhye P.C.

(57) ABSTRACT

A table 2 is provided with a table top 4 and adjustable legs 6. The adjustable legs 6 are pivotally attached to the table top 4. An adjuster 10 is pivotally attached to the adjustable leg 6 and the table top 4 to independently allow the angle and height of each of the adjustable legs 6 to be altered such that the table top 4 may be levelled on uneven ground.

9 Claims, 1 Drawing Sheet

ADJUSTABLE TABLE LEG

BACKGROUND OF THE INVENTION

1. Field of the Invention

This invention relates to tables. More particularly, this invention relates to tables having adjustable legs.

2. Description of the Prior Art

It is known to provide tables with adjustable legs. Examples of such tables are described in U.S. Pat. No. 4,237,795, U.S. Pat. No. 4,259,909, U.S. Pat. No. 4,273,306 and U.S. Pat. No. 5,649,493. In these known tables the adjustment mechanisms are designed such that the legs are all moved together to vary the height of the table top.

SUMMARY OF THE INVENTION

Viewed from one aspect the present invention provides a table comprising:

(i) a table top;

(ii) at least one adjustable leg pivotally attached to said table top; and (iii) an adjuster for independently adjusting each adjustable leg, said adjuster being pivotally attached to said table top and said adjustable leg; wherein (iv) said adjuster can be varied to adjust the angle between said adjustable leg and said table top thereby varying the height and angle of said table top such that said table can be levelled on uneven ground.

The invention recognises that in certain circumstances it is highly desirable that the adjustable legs should be able to move independently of one another so as to compensate for uneven ground. In this way, the legs may be independently adjusted so that they all contact the ground with the table level, firm and at the desired height. An example of a circumstance where this facility is highly advantageous is upon the deck of a boat. Boat decks frequently do not have a single level area of sufficient size to accommodate a table, but rather are characterised by many small stepped and shelved areas that can separately support a leg of the table providing the leg can be appropriately adjusted.

The adjuster could take many forms. However, in preferred embodiments said adjustable leg pivots in a single plane and said adjuster is a variable length strut with one end pivotally attached to said table top and the other end pivotally attached to said adjustable leg.

Providing an adjustable leg that pivots only in a single plane together with a variable length strut performing the role of the adjuster provides an advantageously simple and effective implementation.

The variable length strut can in turn be implemented in many different ways. However, in preferred embodiments of the invention said variable length strut comprises a central sleeve receiving at its threaded ends oppositely threaded coaxial rods, each said rod being pivotally attached to a respective one of said table top and said adjustable leg such that rotation of said sleeve relative to said rods either draws said rods together or forces said rods apart thereby shortening or lengthening said variable length strut.

The use of a threaded sleeve receiving oppositely handed threaded rods provides a very direct and robust mechanism for implementing the adjuster.

In order to improve the ease of use of the table said sleeve is positioned outwardly of said adjustable leg. Positioning the sleeve outwardly of the adjustable leg allows a user to more easily reach under the edge of the table from above and twist the sleeve to make the adjustment to the leg without having to turn the table over or crawl underneath the table.

In order to facilitate the table top being able to bear the loads placed upon it by the adjustable leg mechanisms, it is preferred that said table top comprises a table surface attached to a table top frame, said adjustable leg and said adjuster being attached to said table top frame.

A mechanically efficient and effective way of providing a table top frame to support the various parts of the table mechanism is one in which said table top frame includes a cross brace at a corner, said adjustable leg being attached to said cross brace and said adjuster being attached to said corner.

Whilst it will be appreciated that it may be possible to gain most of the advantages of the invention without having all of the legs of the table adjustable (e.g. a single fixed leg), it is strongly advantageous that all of the legs of said table are adjustable legs.

Whilst the table could have three legs, five legs or more, it has been found most practical and useful to employ the invention in embodiments in which said table has four legs.

In order to make the table sufficiently robust to stand up to typically outdoor use, it is preferable that said adjustable leg and said adjuster are made of metal. The above, and other objects, features and advantages of this invention will be apparent from the following detailed description of illustrative embodiments which is to be read in connection with the accompanying drawings.

DESCRIPTION OF THE PREFERRED EMBODIMENTS

Figure 1:
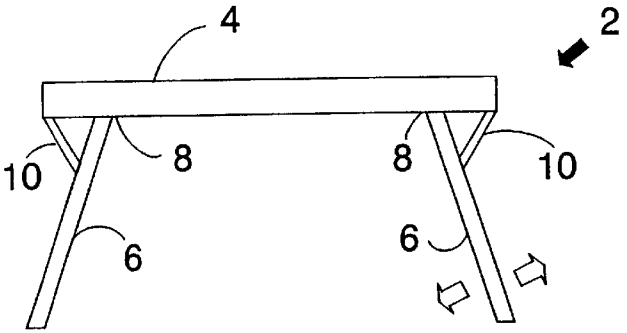
FIG. 1 illustrates the side view of an adjustable leg table.

FIG. 1 shows a table 2 comprising a table top 4 and adjustable legs 6. The adjustable legs 6 are pivotally attached to the table top 4 at a pivot 8. An adjuster 10 is associated with each adjustable leg 6 and is pivotally attached at each of its respective ends to the table top 4 and the adjustable leg 6. The table shown in FIG. 1 has four legs, one at each corner. The table may be constructed of stainless steel, steel, wood, plastics or a combination thereof.

Figure 2:
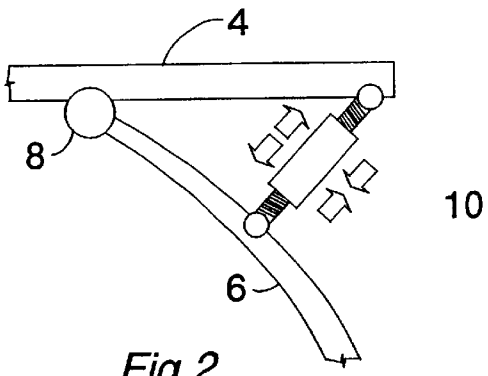
FIG. 2 illustrates an adjustable leg and adjuster mechanism at one corner of the table of FIG. 1.

FIG. 2 shows the adjustable leg 6 and the adjuster 10 in more detail. The adjustable leg 6 is pivotally attached to the table top 4 via a pivot 8 that allows the adjustable leg 6 to rotate in a single plane. The adjuster 10 is in the form of a variable length strut that either increases or decreases in length thereby pivoting the adjustable leg 6 about the pivot 8.

Figure 3:
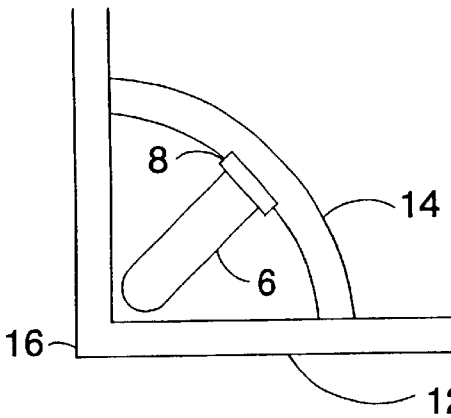
FIG. 3 illustrates a plan view of a table top frame and adjustable leg with the table surface and adjuster removed.

The table top 4 is made of a table surface supported by a table top frame 12. FIG. 3 shows part of the table top frame 12 with the table surface removed. The corner 16 of the table top frame 12 is supported by a cross brace 14. The adjustable leg 6 is pivoted from the cross brace 14. The adjuster 10 (not shown in FIG. 3) extends between the corner 16 of the table top frame 12 and the adjustable leg 6 at a portion part way along its length.

Figure 4:
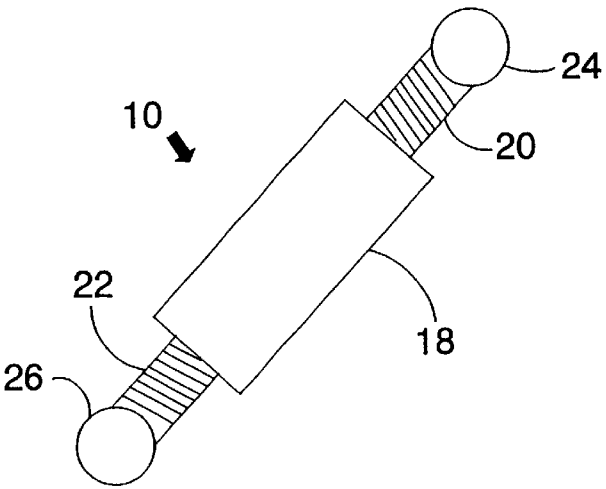
FIG. 4 illustrates the adjuster in more detail.

FIG. 4 shows the adjuster 10 comprising an internally threaded sleeve 18 receiving oppositely handed threaded rods 20, 22 at each of its ends. Pivots 24, 26 are provided at the ends of the threaded rods for attachment respectively to the corner 16 of the table top frame 12 and a point along the length of the adjustable leg 6. In operation, turning the sleeve 18 clockwise or anticlockwise will respectively shorten or lengthen the adjuster 10 in the manner illustrated in FIG. 2. The pivots 24, 26 at the ends of the treaded rods, 20, 22 may also operate to allow pivoting in a single plane that is common to the plane in which the adjustable leg 6 pivots.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

I claim:

1. A table mountable on an uneven surface, said table comprising:

(i) a table top;

(ii) at least one adjustable leg, said leg having one end pivotally attached to said table top and a second end resting on said uneven surface; and (iii) an adjuster for independently adjusting each adjustable leg, said adjuster being pivotally attached to said table top and said adjustable leg; wherein (iv) said adjuster can be varied to adjust the angle between said adjustable leg and said table top thereby varying the height and angle of said table top such that said table can be leveled on said uneven surface.

2. A table as claimed in claim 1, wherein said adjustable leg pivots in a single plane and said adjuster is a variable length strut with one end pivotally attached to said table top and the other end pivotally attached to said adjustable leg.

3. A table as claimed in claim 2, wherein said variable length strut comprises a central sleeve receiving at its threaded ends oppositely threaded coaxial rods, each said rod being pivotally attached to a respective one of said table top and said adjustable leg such that rotation of said sleeve relative to said rods either draws said rods together or forces said rods apart thereby shortening or lengthening said variable length strut.

4. A table as claimed in claim 3, wherein said sleeve is positioned outwardly of said adjustable leg.

5. A table as claimed in claim 1, wherein said table top comprises a table surface attached to a table top frame, said adjustable leg and said adjuster being attached to said table top frame.

6. A table as claimed in claim 5, wherein said table top frame includes a cross brace at a corner, said adjustable leg being attached to said cross brace and said adjuster being attached to said corner.

7. A table as claimed in claim 1, wherein all of the legs of said table are adjustable legs.

8. A table as claimed in claim 1, wherein said table has four legs.

9. A table as claimed claim 1, wherein said adjustable leg and said adjuster are made of metal.

* * * * *